US012714180B2

(12) United States Patent
Casali et al.

(10) Patent No.: US 12,714,180 B2
(45) Date of Patent: Aug. 25, 2026

(54) FOOTWEAR DYNAMIC SOLE

(71) Applicant: WAHU S.R.L., Milan (IT)

(72) Inventors: Patrizia Casali, Milan (IT); Fanny Boria, Milan (IT); Mattia De Santis, Tribiano (IT); Ivo Emanuele Francesco Boniolo, Bovisio Masciago (IT)

(73) Assignee: WAHU S.R.L., Milan (IT)

( * ) Notice: Subject to any disclaimer, the term of this patent is extended or adjusted under 35 U.S.C. 154(b) by 329 days.

(21) Appl. No.: 17/593,926

(22) PCT Filed: Mar. 25, 2020

(86) PCT No.: PCT/IB2020/052804
§ 371 (c)(1),
(2) Date: Sep. 28, 2021

(87) PCT Pub. No.: WO2020/201923
PCT Pub. Date: Oct. 8, 2020

(65) Prior Publication Data

US 2022/0175078 A1 Jun. 9, 2022

(30) Foreign Application Priority Data

Mar. 29, 2019 (IT) ..... 102019000004749

(51) Int. Cl.
*A43B 3/24* (2006.01)
*A43B 13/22* (2006.01)

(52) U.S. Cl.
CPC ..... *A43B 3/246* (2013.01); *A43B 13/22* (2013.01)

(58) Field of Classification Search
CPC ..... A43B 13/20; A43B 13/203; A43B 13/206; A43B 21/28; A43B 13/189; A43B 1/0018; A43C 15/14; A43C 15/168; A43C 15/108
(Continued)

(56) References Cited

U.S. PATENT DOCUMENTS 4,358,902 A * 11/1982 Cole ..... A43B 13/206 36/35 B
4,873,774 A * 10/1989 Lafever ..... A43C 15/14 36/134
(Continued)

FOREIGN PATENT DOCUMENTS

CN 2076769 U 5/1991
CN 202496504 U 10/2012
(Continued)

OTHER PUBLICATIONS

Translation of NO_316251_B1 (Year: 2004).*
(Continued)

*Primary Examiner* — Grady Alexander Nunnery
(74) *Attorney, Agent, or Firm* — LUCAS & MERCANTI, LLP

(57) ABSTRACT

A footwear includes a footwear sole including a first layer defining a leaning surface configured to face, in use, a walking surface and a second layer including a plurality of chambers and coupled to the first layer. The sole includes an actuation system including a fluid source connected to said the plurality of chambers. The actuation system controls the supply of a fluid to the plurality of chambers between a rest condition and an active condition. In the rest condition the chambers have a first volume and determine a first configuration of the first layer, while in the active condition the chambers have a second volume greater than the first volume and determine a second configuration of the first layer wherein the leaning surface has a plurality of bumps at each of the plurality of chambers.

9 Claims, 4 Drawing Sheets

(58) Field of Classification Search
USPC ..... 36/29, 35 B, 61
See application file for complete search history.

(56) References Cited

U.S. PATENT DOCUMENTS

| | | | | | |
|---|---|---|---|---|---|
| 4,887,367 | A * | 12/1989 | Mackness | A43B 1/0018 36/35 B |
| 5,222,312 | A * | 6/1993 | Doyle | A43B 13/203 36/28 |
| 5,257,470 | A * | 11/1993 | Auger | A43B 23/029 36/114 |
| 5,269,080 | A | 12/1993 | Davis | |
| 5,813,142 | A | 9/1998 | Demon | |
| 6,125,556 | A | 10/2000 | Peckler et al. | |
| 7,316,081 | B1 * | 1/2008 | Cheng | A43B 17/08 36/3 R |
| 2008/0066348 | A1 | 3/2008 | O'Brien et al. | |
| 2010/0094184 | A1 * | 4/2010 | Wong | A61H 9/0078 601/149 |
| 2011/0047830 | A1 * | 3/2011 | Francello | A43C 15/14 36/134 |
| 2011/0126422 | A1 | 6/2011 | Vattes et al. | |
| 2012/0073161 | A1 * | 3/2012 | Doyle | A43B 13/203 36/29 |
| 2015/0305445 | A1 | 10/2015 | Bachmann | |
| 2016/0302522 | A1 * | 10/2016 | Meschter | A43B 13/181 |

FOREIGN PATENT DOCUMENTS

| | | | | | |
|---|---|---|---|---|---|
| CN | 203723523 | U | | 7/2014 | |
| CN | 205180515 | U | | 4/2016 | |
| CN | 105852310 | A | | 8/2016 | |
| EP | 2355675 | B1 | | 3/2017 | |
| EP | 3202275 | A1 | | 8/2017 | |
| GB | 2447505 | A | * | 9/2008 | A43B 13/203 |
| JP | H08299025 | A | | 11/1996 | |
| KR | 101591036 | B1 | | 2/2016 | |
| NO | 316251 | B1 | * | 1/2004 | A43C 15/14 |
| WO | WO-9118526 | A1 | * | 12/1991 | A43B 23/047 |
| WO | WO-0008962 | A1 | | 2/2000 | |
| WO | 2020201925 | A1 | | 10/2020 | |
| WO | WO-2020201923 | A1 | | 10/2020 | |

OTHER PUBLICATIONS

Translation of WO-9118526-A1 (Year: 1991).*
International Search Report and Written Opinion mailed Jul. 2, 2020, in International Patent Application No. PCT/IB2020/052804, EPO, Netherlands, 10 pages.
Office Action for Corresponding Chinese Patent Application No. 202080039580.9, dated Aug. 11, 2023, pp. 1-9, English translation 17 pages.
International Search Report and Written Opinion for Corresponding International Application No. PCT/IB2020/052806, Jun. 12, 2020, 10 pages.

* cited by examiner

FOOTWEAR DYNAMIC SOLE

TECHNICAL FIELD

The present description refers in general to the footwear production field, and more specifically it relates to a footwear sole the structure of which can be dynamically modified by the user and to a related method for modifying the structure of a footwear sole. The present description also relates to a footwear comprising this sole.

TECHNICAL BACKGROUND

Slippage is one of the main risks a user incurs during his working/non-working activities. Slippage is caused by the decrease in the adhesion between the sole and the walking surface. Said decrease in the adhesion occurs when the ratio between the horizontal component and the vertical component of the force impressed by the user's foot on the leaning surface falls below the friction coefficient between the same sole and the leaning surface.

In order to reduce the slippage risk, only specific compounds or specific designs have been studied to optimize the adherence of the sole with a certain type of walking surface.

However, these are substantially "static" solutions that do not allow adapting the characteristics of the sole to those of the walking surface. In fact, since during the performance of his activities the user may find himself walking on surfaces with different characteristics or on surfaces the characteristics of which vary due to weather conditions, the use of shoes with soles according to the known technique resolve only partially the slippage problem.

SUMMARY OF THE DESCRIPTION

Therefore, the present description aims to provide a footwear sole which allows to overcome the drawbacks above mentioned with reference to the prior art and/or to obtain further advantages. This is achieved through a footwear sole, a footwear and a method as defined in the respective independent claims. Secondary characteristics and specific embodiments of the object of the present description are defined in the corresponding dependent claims.

The footwear sole according to the present description comprises a first layer defining a leaning surface configured to face, in use, i.e. during a user's walk, towards a walking surface. The sole according to the present description moreover comprises a second layer which, in turn, includes a plurality of chambers and is coupled to the first layer. These chambers represent substantially hollow spaces within said second layer. The sole also includes an actuation system. Said actuation system, in turn, comprises a fluid source connected to said plurality of chambers and comprising a feeding fluid. The actuation system of the footwear sole according to this description is configured to control the supply of the feeding fluid to said plurality of chambers between a rest condition and an active condition, and vice versa. In said rest condition, the chambers have a first volume and are apt to determine a first configuration of the first layer. In said active condition the chambers have a second volume, greater than said first volume, and are apt to determine a second configuration of the first layer wherein the leaning surface has or forms a plurality of bumps at each of said plurality of chambers. The term "bumps" means within the scope of the present disclosure a plurality of protuberances, of protruding elements in a more or less pronounced way or similar elements apt to determine a roughness more or less accentuated on the walking surface.

In other words, in the footwear sole according to the present description, the plurality of chambers within the second layer are expandable chambers, or expansion chambers, apt to induce a certain configuration to the first layer. Stated differently, the volume adopted by the plurality of chambers determines the configuration of the first layer. That is to say, the volume adopted by the plurality of chambers of the second layer acts on the first layer, determining the configuration thereof. In particular, the increase in volume of the chambers caused by the feeding fluid acts on the first layer causing a deformation of the latter such that a plurality of bumps, protrusions or swellings are present or formed on the leaning surface at each of said chambers.

Therefore according to the present description, the rest condition of the chambers corresponds to a contraction condition of the chambers themselves while the active condition of the chambers corresponds to an expanded condition of the latter. This means that in the rest condition the chambers are contracted or retracted and therefore occupy less space with respect to the active condition wherein they are expanded and occupy a greater space causing the presence of said protuberances or protrusions in the leaning surface.

The formation of bumps protrusions or swellings on the first layer, when it is in said second configuration, determines an extension of the leaning surface of the sole. It follows that, advantageously, in case of uneven walking surfaces, the contact surface between the footwear sole and the walking surface being greater, the friction coefficient between the sole itself and the leaning surface increases and the slippage risk for a user decreases. In other words, especially in the case, for example, of soft, grassy, snowy or muddy ground, the contact surface between the sole and the ground, thanks to the presence of said bumps, protrusions or swelling, is increased compared to the first configuration of the first layer thus increasing the friction coefficient between the leaning surface and the walking surface.

According to a preferred aspect of the footwear sole according to the present description, in the so-called first configuration of the first layer, the leaning surface is substantially planar, i.e. substantially flat, smooth or bump-free. It follows that, thanks to the presence of the actuation system which controls the supply of the feeding fluid to the plurality of chambers, the leaning surface of the sole can vary, or pass from a substantially flat or planar configuration, suitable for even walking surfaces such as floors in offices or houses, in a configuration having bumps or protuberances, suitable for rough or slippery walking surfaces, and vice versa.

According to a further preferred aspect of the present description, the actuation system comprises at least one channel connecting the feeding fluid source to each chamber. According to this aspect, the at least one channel therefore allows fluid communication between said fluid source and the chambers. It follows that it forms the way, or passage, through which the feeding fluid can flow from the fluid source to the plurality of chambers and, vice versa, from the plurality of chambers to the fluid source. In addition, each chamber of the plurality of chambers can be connected to at least one other chamber of the plurality of chambers by means of one or more channels. That is to say, the chambers can also be interconnected. This advantageously promotes a uniform distribution of the feeding fluid between the different chambers.

According to a further preferred aspect of the present description, the fluid source is associated with an end region or peripheral region of said sole. The fluid source is, therefore, coupled to an end region or portion or to the edges of the sole. In such a way, it is reduced the hindrance that the fluid source can determine when wearing the shoe to which the sole is intended to be coupled.

A further preferred aspect of this description relates to the fact that the actuation system comprises a blocking device configured to oppose the flow of the feeding fluid from the plurality of chambers to the fluid source. According to this aspect, the blocking device is apt to prevent or impede or avoid a feeding fluid return or leakage from the chambers to the fluid source. In this way, advantageously, when the chambers are in active condition, i.e. in an expanded condition, it is prevented the possibility that the feeding fluid contained therein flows towards the fluid source, for example due to a pressure applied to the leaning surface. It follows that, in use, thanks to the presence of the blocking device, the chambers are kept in an active condition and therefore the second configuration of the first layer is kept even during a user's walk.

Furthermore, according to another preferred aspect of the present description, the fluid source of the footwear sole comprises a tank and a stem which can slide inside said tank. In other words, the fluid source includes a receptacle or container for containing the feeding fluid and a stem, piston or plunger, which can be shifted inside said container or receptacle to supply the chambers with the feeding fluid.

According to another preferred aspect of the present description, the tank is configured to contain said feeding fluid and said stem is configured to slide in a first direction inside the tank, so as to exert pressure on the feeding fluid contained within said tank, and to slide in the tank in a second direction, opposite to the first one, to allow a return of the feeding fluid into the tank. That is to say that the stem is configured to move within the tank modifying the room available, within said tank, for the feeding fluid.

According to a further preferred aspect of the present disclosure, the stem is configured to be electrically or manually operated by a user. That is to say, said stem can be operated by a user by hand or electrically.

In addition, according to another preferred aspect of the present description, the second layer has a bellows-like structure at each chamber. It follows that according to this aspect of the present description, the second layer at each chamber has a bellows-like structure such that, when the chambers are in the rest condition, the second layer has a plurality of inward folds or creases at the chambers. Said again with different words, in the chamber rest condition, the folds or creases are retracted or contracted. That is, when the chambers are in rest condition, the folds or creases of the second layer extend in a direction opposite to the first layer. Advantageously, this allows that, upon the supply of feeding fluid inside the chambers, the folds or creases spread out in the direction of the first layer resulting in the formation of bumps or protrusions on the leaning surface. Similarly, this also allows, upon the inflow of feeding fluid from the chambers to the fluid source, that said bumps or protrusions collapse allowing the first layer to adopt the first configuration. In particular, said folds or creases can be concentric. Advantageously, according to this aspect, the bumps on the leaning surface of the first layer, when the latter is in the second configuration, have a tapered shape. The tapered shape of the bumps allows to further prevent sliding on uneven or rough surfaces.

In particular, according to the previous aspect, the folds or creases are apt to be retracted, so as to allow the chambers to adopt the rest condition, and to be unfolded or spread out, so as to allow the chambers to adopt the active condition. In other words, the folds or creases are configured to be retracted or unfolded to allow the chambers to adopt the rest condition and active condition respectively. That is to say that the condition, active or rest, adopted by the chamber is determined according to the arrangement of the folds or creases.

According to another preferred aspect of the present description, the sole comprises a third layer coupled to the second layer and configured, in use, to support the user's foot sole.

Finally, a further preferred aspect of the present description relates to the fact that the first layer and/or said third layer is made of rubber. In fact, rubber is an easily deformable, elastic material that helps contrasting slippage.

A further object of the present description is a footwear comprising the sole according to one of the embodiments of the present description. In particular, the fluid source of the sole according to the present description can be arranged at an end zone or region, such as the heelbone region. Advantageously, this makes the user's movement less restrained.

The present description also provides a method for modifying the configuration of a footwear sole leaning surface. The method includes the steps of:

- providing a first layer of a footwear sole, defining said leaning surface,
- providing a second layer of a footwear sole comprising a plurality of chambers,
- coupling the first layer and the second layer,
- providing an actuation system including a fluid source, comprising a feeding fluid and connected to said plurality of chambers,
- controlling the supply of the feeding fluid from the fluid source to said plurality of chambers, so as to determine a variation in the volume of said chambers between a rest condition and an active condition.

In particular, in said rest condition the chambers have a first volume and determine a first configuration of the first layer and in said active condition the chambers have a second volume, greater than said first volume, and determine a second configuration of the first layer where the leaning surface presents or forms a plurality of bumps at each of said plurality of chambers.

The method therefore involves inducing a deformation of the leaning surface of the first layer upon the variation in the volume of the chambers of the second layer. In other words, according to this method it is possible to determine the deformation of the leaning surface by acting on the conditions of the second layer.

According to a preferred aspect of the present description, the control of the supply of the feeing fluid from the fluid source to said plurality of chambers comprises opening or interrupting a fluid communication between the fluid source and each chamber of said plurality of chambers.

The step regarding the control of the feeing fluid supply is therefore performed by selectively allowing fluid communication between the fluid source and each chamber of the plurality of chambers.

According to a preferred aspect of the present description, the step of providing the actuation system comprises providing said fluid source comprising a tank and a stem which can slide inside said tank. In other words, providing the fluid source comprises providing a tank, apt to contain the feeding fluid, and a stem slidable or movable within the tank.

According to a further aspect of the present description, the step of controlling the fluid supply, so as to determine a variation in the volume of each chamber of said plurality of chambers from a rest condition to an active condition, comprises: opening the fluid communication between the fluid source and the chambers; sliding said stem inside said tank so that the feeding fluid reaches the plurality of chambers; interrupting the fluid communication between the fluid source and the chambers. In other words, the step of controlling the fluid supply to vary the volume of each chamber of said plurality of chambers from a rest condition to an active condition, comprises: allowing the fluid communication between the fluid source and the chambers; sliding the stem within the tank to deliver the supply fluid to the plurality of chambers and, finally, preventing the fluid communication between the fluid source and the chambers.

Furthermore, according to a preferred aspect of the present description, the step of controlling the fluid supply so as to determine a variation of the condition of each chamber of said plurality of chambers from an active condition to a rest condition comprises opening the fluid communication between the fluid source and the chambers. In other words, the step of controlling the supply of the feeding fluid in order to vary the volume of each chamber of said plurality of chambers from an active condition to a rest condition, comprises: allowing the fluid communication between the fluid source and the chambers so that the feed fluid contained within the chambers returns to the tank.

According to a preferred aspect of the present description, the step of controlling the fluid supply so as to determine a variation in the configuration of each chamber of said plurality of chambers from an active condition to a rest condition further comprises: applying a pressure on the first layer and/or on the second layer. By applying a compression to the first layer and/or the second layer, it is possible to promote the return of the feeding fluid from the chambers to the tank.

According to a preferred aspect of the present description, providing the actuation system further comprises providing at least one channel, which connects the fluid source to each chamber. The fluid communication between the fluid source and the plurality of chambers is obtained by making a channel which connects indeed said fluid source with said plurality of chambers.

According to the latter preferred aspect of this description, the method also provides connecting each of the chambers of the plurality of chambers to at least one other chamber of the plurality of chambers by means of one or more channels. In other words, providing the actuation system also includes providing a plurality of channels interconnecting the chambers so that each chamber is connected, i.e. is in fluid communication, with at least one other chamber.

Finally, according to a further preferred aspect of the description, providing the actuation system also includes providing a blocking device configured to contrast the flow of fluid from the plurality of chambers to the fluid source. Even more preferably said blocking device is configured for selectively allowing fluid communication between the fluid source and the chambers.

Further advantages, characteristics and the uses of the object of the present description will be clear from the following detailed description of embodiments thereof, presented as non-limiting examples.

It is however evident that each embodiment of the object of the present description can have one or more of the advantages listed above; in any case it is not required that each embodiment simultaneously has all the listed advantages.

BRIEF DESCRIPTION OF THE DRAWINGS

Reference will be made to the figures of the annexed drawings, wherein.

ILLUSTRATIVE EMBODIMENTS

Figure 1:
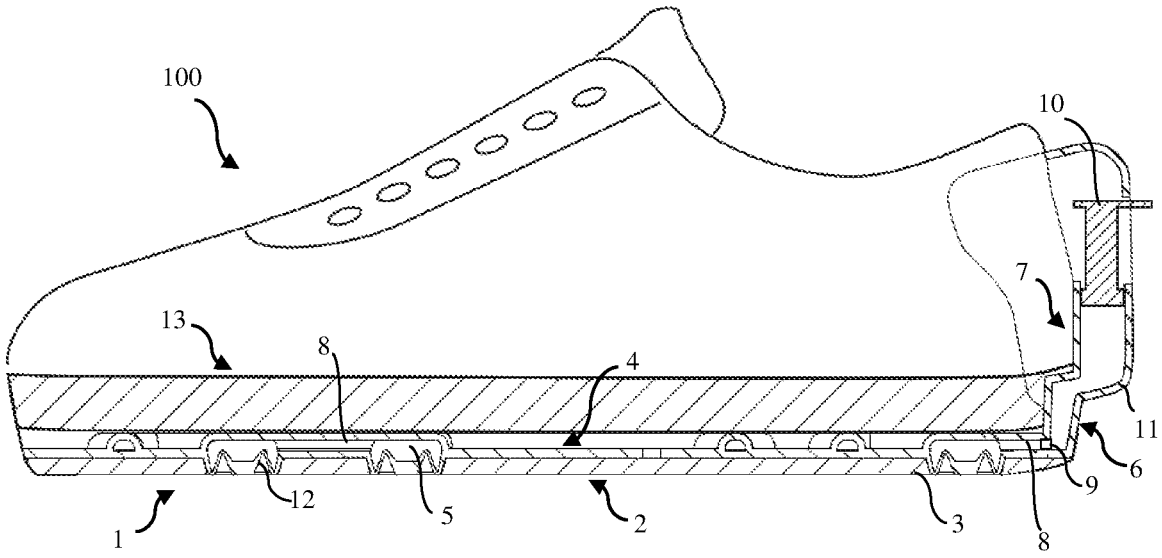
FIG. 1 represents a side section of a sole and a footwear according to the present description.
Figure 2:
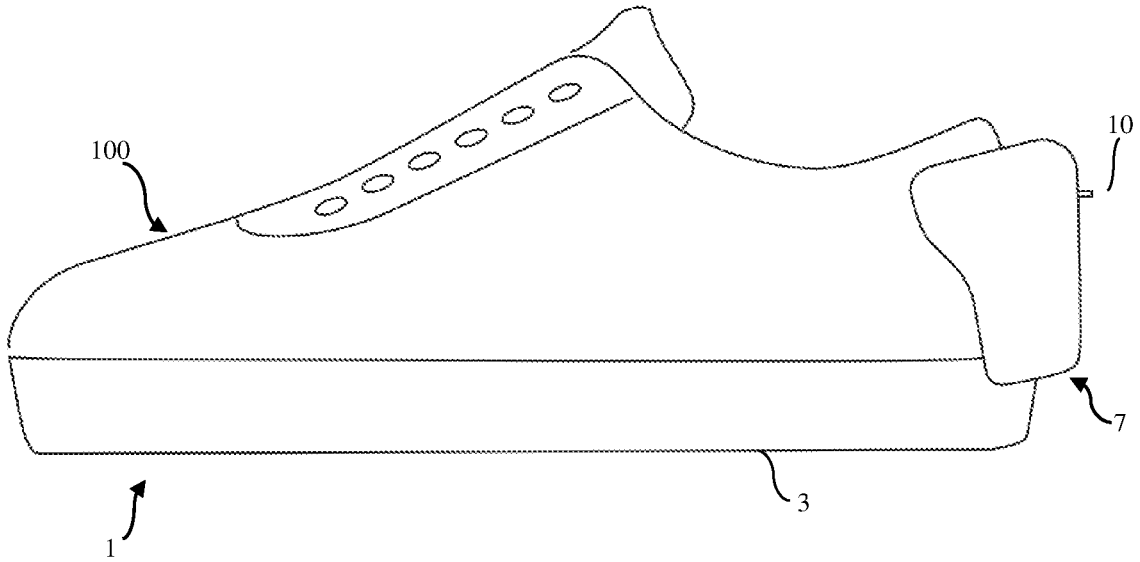
FIG. 2 represents a side section of a sole and a footwear according to the present description wherein the first layer of the sole is in the first configuration.
Figure 3:
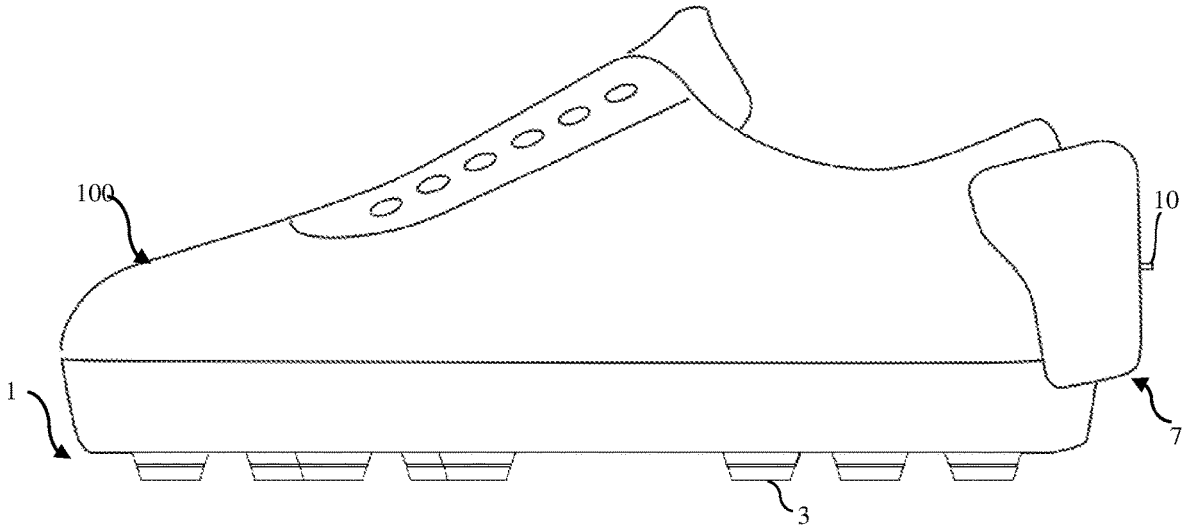
FIG. 3 represents a side section of a sole and a footwear according to the present description wherein the first layer of the sole is in the second configuration.
Figure 4:
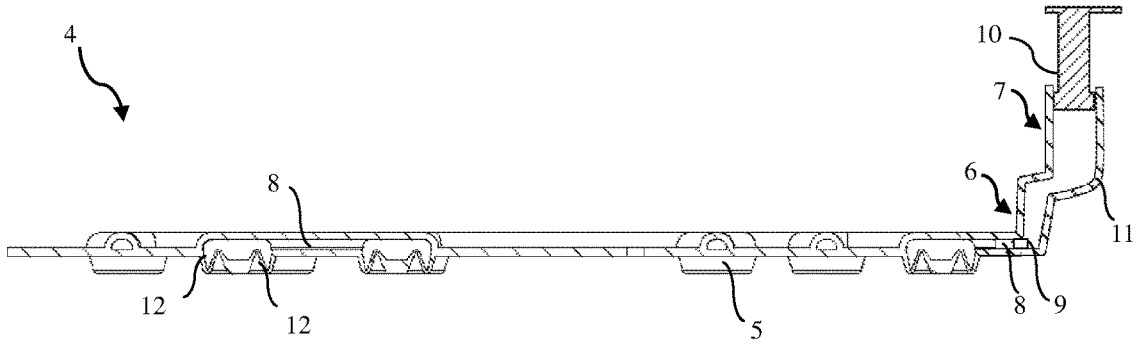
FIG. 4 shows a side section of the second layer and the actuation system of a sole according to the present description wherein the chambers of the second layer are in the rest condition.
Figure 5:
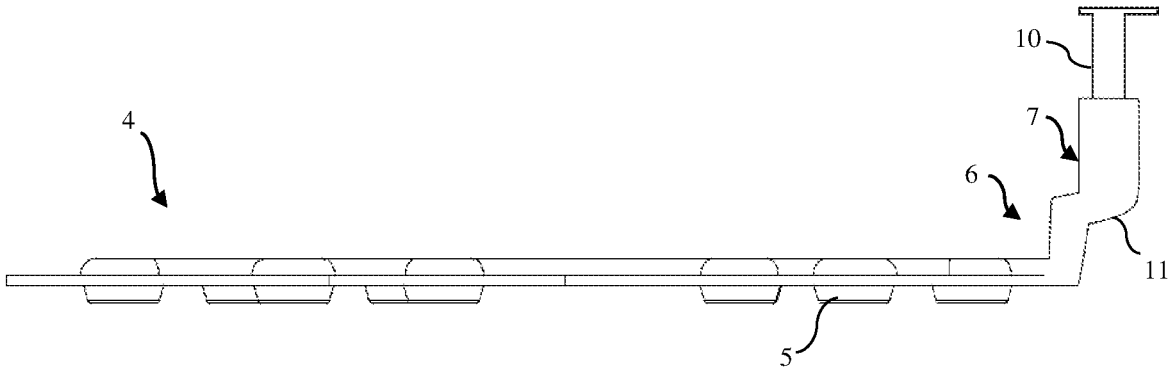
FIG. 5 shows a side view of the second layer and the actuation system of a sole according to the present description wherein the chambers of the second layer are in the rest condition.
Figure 6:
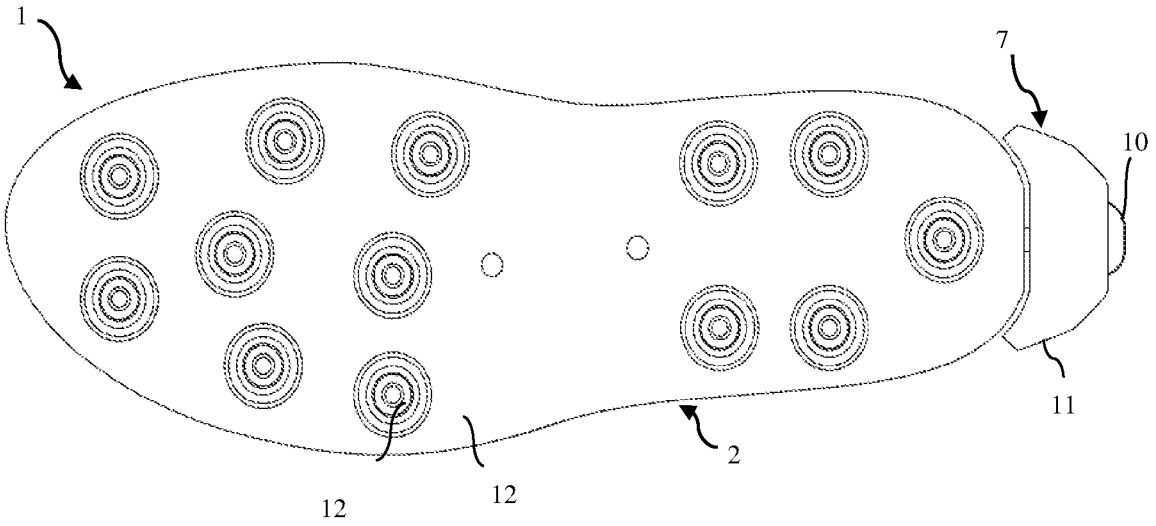
FIG. 6 shows a bottom view of a sole or a footwear according to the present description.
Figure 7:
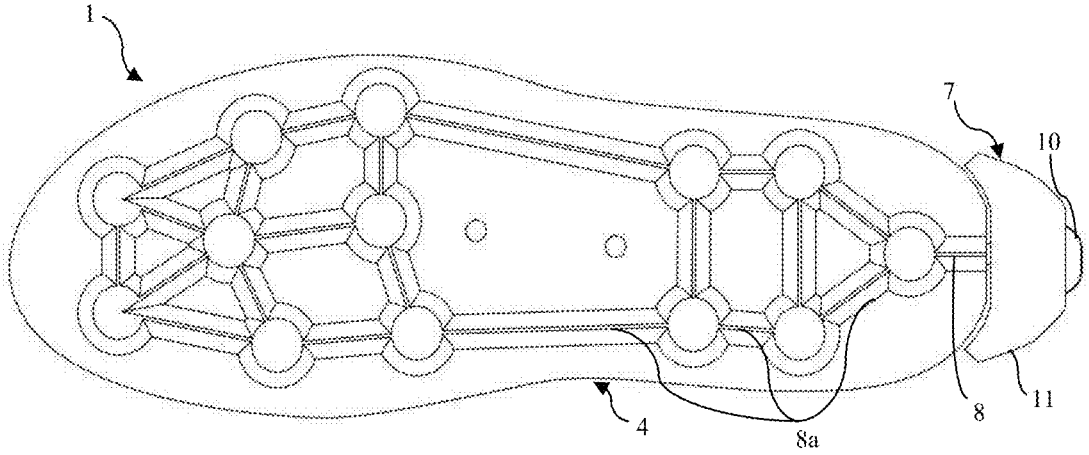
FIG. 7 shows a top view of a sole according to the present description.

With reference to the attached figures, an embodiment of a footwear sole is indicated with the reference number 1.

The expression "footwear sole" means within the scope of the present description an element configured to be associated with a footwear, in particular with the top portion, for example with an upper, of a footwear.

The sole 1 comprises a first layer 2, or lower layer, intended, in use, to come into contact with the walking surface, or with the ground on which the footwear lays, during a user's walk. Specifically, such first layer 2 defines or has a leaning surface 3 configured to face, in use, said walking surface. The footwear sole 1 according to the present description further comprises a second layer 4 coupled to said first layer 2. The second layer 4 overlaps the first layer 2, i.e. it is coupled at the surface of the first layer 2 opposite the leaning surface 3. The first layer 2 therefore represents an outer or lower coating of the second layer 4. Preferably, said first layer 2 and said second layer 4 are shaped elements having substantially the same shape as a user's foot sole.

The sole 1 also includes a plurality of chambers comprised within the second layer 4. In other words, the chambers 5 represent substantially hollow spaces within the second layer 4. The chambers 5 are therefore enclosed or confined within the second layer 4.

The sole 1 further comprises an actuation system 6 which, in turn, includes a fluid source 7 comprising a feeding fluid and connected to said plurality of chambers 5. The actuation system 6 is configured to adjust, or control, the supply of the feeding fluid to the plurality of chambers 5 and consequently to determine the condition of the chambers 5. In particular, the condition of the chambers 5 can vary between a rest condition and an active condition, and vice versa. More specifically, in said rest condition the chambers 5 have a first volume, v1, while in said active condition they have a second volume, v2, where said second volume v2 is greater than the first volume v1. The chambers 5 are, thus, deformable between said rest condition, where they adopt a first volume v1, and a said active condition, where they adopt a second volume v2 greater than the first one.

Since the first layer 2 is coupled to the second layer 4, the volume adopted or occupied by the plurality of chambers determines the configuration of the first layer 2. A rest condition of the chambers 5 determines a first configuration of the first layer 2 and an active condition of the chambers 5 determines a second configuration of the first layer 2, wherein the leaning surface 3 has a bump at each chamber 5, respectively. So, in said second configuration of the first layer 2, the leaning surface 3 has or forms a plurality of bumps or protrusions with respect to the first configuration of the first layer 2. More specifically, in the second configuration, the leaning surface 3 of the first layer 2 has a protrusion or protuberance or bump at each of said plurality of chambers 5. Consequently, the number of bumps or protrusions on the leaning surface 3 is equal to the number of chambers 5 in the second layer 4.

It follows that the actuation system 6 is thus configured to control the condition of said plurality of chambers 5 between the rest condition and the active condition in order to modify a configuration of the first layer 2 of the sole 1 between a first and a second configuration. More particularly, the actuation system 6 is apt to control the condition of said plurality of chambers 5 and therefore to control the configuration of the second layer 4. The first layer 2 being coupled to the second layer 4 varies its configuration accordingly.

Preferably, according to a preferred aspect of the present description, in the first configuration of the first layer 2, the leaning surface 3 is substantially flat, i.e. free of bumps or protrusions.

According to a further preferred aspect of the present description, the actuation system 6 comprises at least one channel 8 connecting the fluid source 7 to each of the chambers 5. Said at least one channel 8 is thus apt to act as a passage or a path for placing in fluid communication the fluid source 7 and the plurality of chambers 5. Through the at least one channel 8 it is possible to causing a feeding fluid to flow from the fluid source 7 into the chambers 5. Preferably according to this preferred aspect, the sole 1 comprises a plurality of secondary channels 8*a* apt to connect the chambers 5 among them. Even more preferably, each of the chambers 5 of the plurality of chambers is connected to at least another chamber 5 by means of one or more channels 8. The chambers 5 are therefore interconnected among them and in fluid communication.

Preferably, the fluid source 7 comprises a tank 11 and a stem 10 which can slide inside said tank 11. The tank 11 therefore acts as a container or collector for containing the feeding fluid, which can be a gaseous or a liquid fluid. That is to say that the tank 11 is configured to contain the feeding fluid therein. The stem 10 is adapted to slide or shift inside the tank 11 between a stroke start position and a stroke end position, varying the room inside the tank 11 where the feeding fluid can be contained. The stem 10 is therefore configured to slide in a first direction inside the tank 11 exerting a pressure on the feeding fluid contained therein. The stem 10 is also configured to slide within the tank 11 in a second direction, opposite to the first, to allow a return of the feeding fluid into the tank 10. The sliding of the stem 10 can take place manually or can be controlled electronically. In other words, the stem 10 is configured to be operated electrically or manually by a user.

Preferably, the actuation system 6 of the footwear sole 1 according to the present description further comprises a blocking device 9 apt to contrast the flow of the feeding fluid from the plurality of chambers 5 to the fluid source 7. Said blocking device 9 is therefore configured to prevent a return of the supply fluid from the chambers 5, in active condition, to the fluid source 7. The blocking device 9 can be for example a valve arranged on the at least one channel 8 to close said channel 8. The blocking device 9 exerts a reversible action, in other words it is configured to be also unblocked or opened and allow the feeding fluid to flow from the chambers 5 to the fluid source 7. The blocking device 9 is thus configured to selectively place in fluid communication between the plurality of chambers 5 with the fluid source 7. In other words, the blocking device 9 is configured to allow or to not allow, a fluid communication between the fluid source 7 and the chambers 5. For example, the blocking device 9 can be an umbrella-type valve. Alternatively, the blocking device 9 can be a lip valve or gooseneck valve.

Preferably, moreover, the fluid source 7 is associated with an end region or peripheral region of the sole 1. The fluid source 7 is therefore coupled to an end region or portion or to the edges of the sole. The fluid source 7 is, thus, preferably arranged at an end region of the sole 1. Even more preferably, the fluid source 7 is arranged at a rear or heelbone region of the sole 1.

Preferably, each chamber 5 is configured to expand and contract in a direction orthogonal to the first layer 2. Since the second layer 4 overlaps the first layer 2, each chamber 5 is, thus, configured to be axially compressible and extensible.

Preferably, according to a preferred aspect of the present description, the second layer 4 has, at each chamber 5, a bellows-like structure. According to this conformation, when the chambers 5 are in the rest condition, the second layer 4 has, at the chambers 5, a plurality of inward folds or creases 12, that means extending in the opposite direction with respect to the first layer 2. In other words, in the rest condition, the folds or creases 12 are formed in a direction away from the first layer 2. The folds or creases 12 are apt to be retracted so as to allow the chambers 5 to adopt the rest condition. Even more preferably said folds or creases 12 are concentric. That is to say that the folds or creases 12 are concentrically arranged one within the other. The folds or creases 12 are also apt to be unfolded or spread out so as to allow the chambers 5 to adopt the active condition. The bellows-like structure is apt to allow that, upon the supply of feeding fluid inside the chambers 5, i.e. when the chambers 5 are in active condition, the folds or creases 12 of the second layer 4 unfold in the direction of the first layer 2. When the folds or creases 12 deploys, they deform the first layer 2 and cause to the formation of the bumps or protrusions on the leaning surface 3. Furthermore, following the flow of feeding fluid from the chambers 5 to the fluid source 7, i.e. when said chambers 5 are in the rest condition, said bumps or protrusions collapse allowing the first layer 2 to adopt the first configuration.

Furthermore, according to a further preferred aspect of the present description, the sole 1 also comprises a third layer 13 coupled to the second layer 4 and configured, in use, to support the sole of a user's foot.

Preferably, said third layer 13 and/or said first layer 2 are made of elastomeric material, such as for example rubber. Preferably the second layer 4 is made of elastomeric and impermeable to fluids material.

Finally, the sole 1 according to one of the embodiments described so far can be associated with the upper of a footwear 100. According to a particularly preferred aspect, the footwear 100 comprises the fluid source 7 in a rear or heel region of the footwear 100 itself.

Finally, the present description relates to a method for modifying the configuration of a leaning surface 3 of a footwear sole 1.

In describing this method, elements and parts of the sole 1 involved in the method and having the same function and the same structure as the elements and parts of the sole 1 previously described retain the same reference number and are not again described in detail.

The method for modifying the configuration of a leaning surface 3 of a footwear sole comprises the steps of:

providing a first layer 2 of a footwear sole 1, defining said leaning surface 3, providing a second layer 4 of a footwear sole 1 comprising a plurality of chambers 5, coupling the first layer 2 and the second layer 4, providing an actuation system 6 including a fluid source 7, comprising a feeding supply and connected to said plurality of chambers 5, controlling the supply of the feeding fluid from the fluid source 7 to said plurality of chambers 5, so as to determine a variation in the volume of said chambers 5 between a rest condition and an active condition.

In particular, in said rest condition the chambers 5 have a first volume, v1, and determine a first configuration of the first layer 2 and in said active condition the chambers 5 have a second volume, v2, greater than said first volume, v1, and determine a second configuration of the first layer 2 where the resting surface 3 has or forms a plurality of bumps in correspondence with each of said plurality of chambers 5.

In particular, the connection between the fluid source 7 and the plurality of chambers is a fluid communication.

The method, therefore, provides inducing a deformation of the leaning surface 3 of the first layer 2 upon the variation of the volume of the chambers 5 of the second layer 4. In other words, according to this method it is possible to determine the deformation of the leaning surface 3 acting on the conditions of the second layer 4, in particular of the chambers 5.

According to a preferred aspect of the method, the step of providing the actuation system 6 further comprises providing at least one channel 8, which connects the fluid source 7 to each chamber 5. The channel 8 allows a fluid connection between the fluid source 7 and the chambers 5. Even more preferably, such step also comprises connecting each of the chambers 5 of the plurality of chambers to at least one other chamber 5 of the plurality of chambers by means of one or more channels 8. The chambers 5 are therefore placed in fluid communication among them.

In particular, according to a preferred aspect of the method according to the present description, the control of the supply of the feeding fluid from the fluid source 7 to said plurality of chambers 5 comprises opening or interrupting the fluid communication between the fluid source 7 and each chamber 5 of said plurality of chambers. That is to say that the control of the variation of the volume of the chambers 5 in the second layer 4 takes place through the opening or interruption of the fluid communication between the chambers 5 and the fluid source 7.

The method may also provide that as part of the step of providing the actuation system 6 it is provided a fluid source 7 comprising a tank 11 and a stem 10 slidable inside said tank 11. In other words, preferably, it is also provided a further step which comprises providing for the fluid source 7 a tank 11 and a stem 10 which can slide inside said tank 11.

Preferably, according to such preferred aspect, in order to vary the condition of each chamber 5 from a rest condition to an active condition, the step of controlling the fluid supply comprises the opening the fluid communication between the fluid source 7 and the chambers 5, the sliding of the stem 10 inside the tank 11 so that the feeding fluid reaches the plurality of chambers 5 and the interruption of the fluid communication between the fluid source 7 and the chambers 5. This is to say that the feeding fluid contained within the fluid source 7 is delivered to the plurality of chambers 5 by sliding the stem 10 into the tank 11 and allowing the fluid communication between the fluid source 7 and the plurality of chambers 5. The feeding fluid from the tank 11 goes inside the chambers 5. In the active condition, therefore, the feeding fluid is received inside the chambers 5. Therefore, the fluid communication is interrupted or prevented so as to prevent a return of the feeding fluid from the plurality of chambers to the tank 11.

Preferably, the method provides that the provision of the actuation system 6 also includes providing a blocking device 9 configured to contrast the fluid flow from the plurality of chambers 5 to the fluid source 7.

Even more specifically, in this case, in order to vary the condition of each chamber 5 from a rest condition to an active condition, the method therefore provides that the eventual blocking device 9 does not obstruct or block the at least one channel 8 connecting the plurality of chambers 5 and the tank 11 of the fluid source 7, sliding the stem 10 from a stroke start position to a stroke end position so as to deliver the supply fluid from the tank 11 to the chambers 5 through said at least one channel 8 and then blocking or obstructing said at least one channel 8 to prevent the return of the feeding fluid inside the tank 11.

Furthermore, in order to vary the condition of each chamber 5 from an active condition to a rest condition, the step of controlling the supply of the feeding fluid can include opening the fluid communication between the fluid source 7 and the chambers 5. In such a way, the feeding fluid contained within the chambers 5 is returned to the tank 11. Preferably, in order to vary the condition of each chamber 5 from an active condition to a rest condition, the step of controlling the supply of feeding fluid further comprises applying a pressure on the first layer 2 and/or on the second layer 4. This pressure application can occur, for example, during the walking of a user. The user's weight on the first layer 2 and on the second layer 4 determines a variation in the configuration of the chambers 5 from the active condition to the rest condition.

Even more specifically, to vary the condition of each chamber 5 from an active condition to a rest condition, the method step of controlling the supply of feeding fluid can comprise opening or deactivating the eventual blocking device 9 to allow fluid communication between the plurality of chambers 5 and the tank 11 of the fluid source 7. The object of the present description has been in so far described by referring to embodiments thereof. It is to be understood that other embodiments which pertain to the same inventive core may exist, all of which are within the scope of protection of the claims set out below.

Any variations or additions may be made by those skilled in the art to the embodiment described and illustrated herein, remaining within the scope of the following claims. In particular, further embodiments may include the technical characteristics of one of the following claims with the addition of one or more technical characteristics described in the text or illustrated in the drawings, taken individually or in any reciprocal combination.

The invention claimed is:

1. A footwear comprising:

an upper; and a footwear sole coupled to the upper along a joint, the footwear sole comprising:

a first layer defining a leaning surface configured to face, in use, a walking surface;

a second layer, coupled to said first layer and comprising a plurality of chambers; and an actuation system including a fluid source comprising a fluid and connected to said plurality of chambers, wherein said fluid source includes a tank integrated into the footwear sole, the tank adapted to hold the fluid, wherein at least a portion of the tank is disposed above at least a portion of the upper;

wherein the actuation system is configured to control a flow of the fluid to said plurality of chambers between a rest condition and an active condition, and vice versa;

wherein in said rest condition the plurality of chambers has a first volume (v1) and determine a first configuration of the first layer;

wherein in said active condition the plurality of chambers has a second volume (v2), greater than said first volume (v1), and determine a second configuration of the first layer wherein the leaning surface has or forms a plurality of bumps at said plurality of chambers;

wherein the second layer comprises a bellows structure at each chamber such that when the plurality of chambers is in the rest condition the second layer has a plurality of folds or creases within the plurality of chambers;

wherein in response to the flow of the fluid into the plurality of chambers, the plurality of folds or creases of the second layer unfolds in a direction of the first layer, wherein in the rest condition the plurality of folds or creases is concentrically arranged; and wherein each of the plurality of bumps of the leaning surface of the first layer, when the first layer is in the second configuration, has a tapered shape;

wherein:

the leaning surface is an external surface of first layer; and each chamber of the plurality of chambers is disposed proximate a respective first region of the leaning surface of the first layer;

wherein when the first layer is in the first configuration:

each of the first regions of the leaning surface of the first layer is in a first plane; and one or more second regions of the leaning surface not proximate the plurality of chambers are in the first plane;

wherein when the first layer is in the second configuration:

the plurality of bumps are located on the leaning surface in the first regions proximate said plurality of chambers;

each of the first regions of the leaning surface of the first layer is not in the first plane; and the one or more second regions of the leaning surface not proximate the plurality of chambers are in the first plane.

2. The footwear according to claim 1, wherein the actuation system comprises at least one channel connecting the fluid source to the plurality of chambers.

3. The footwear according to claim 1, wherein the actuation system comprises a blocking device configured to control a second flow of the fluid from the plurality of chambers to the fluid source.

4. The footwear according claim 1 or 3, wherein said fluid source further comprises a stem which can slide inside said tank.

5. The footwear according to claim 4, wherein said tank is configured to contain said fluid and wherein said stem is configured to slide in a first direction within the tank, so as to exert pressure on the fluid contained in said tank, and to slide within the tank in a second direction, opposite to the first direction, to allow a return of the fluid inside the tank.

6. The footwear according to claim 5, wherein said stem is configured to be operated electrically or manually by a user.

7. The footwear according to claim 1, wherein said plurality of folds or creases is adapted to be retracted, so as to allow the plurality of chambers to adopt the rest configuration, and is further adapted to be unfolded or spread out, so as to allow the plurality of chambers to adopt the active configuration.

8. The footwear according to claim 1, wherein the actuation system comprises a blocking device configured to control the flow of fluid from the plurality of chambers to the fluid source.

9. The footwear according to claim 2, wherein the actuation system comprises a blocking device configured to control the flow of fluid from the plurality of chambers to the fluid source.

* * * * *